US006786223B2

(12) United States Patent
Klinkhammer et al.

(10) Patent No.: US 6,786,223 B2
(45) Date of Patent: Sep. 7, 2004

(54) HARD SURFACE CLEANERS WHICH PROVIDE IMPROVED FRAGRANCE RETENTION PROPERTIES TO HARD SURFACES

(75) Inventors: Michael E. Klinkhammer, Racine, WI (US); Richard S. Valpey, III, Lindenhurst, IL (US); Brandon R. Thalmann, LaPorte, IN (US); Mathew A. Jones, Racine, WI (US); John Tsibouklis, Waterlooville (GB); Maureen J. Stone, Calmore (GB); Richard W. Avery, Radnage (GB)

(73) Assignee: S. C. Johnson & Son, Inc., Racine, WI (US)

( * ) Notice: Subject to any disclaimer, the term of this patent is extended or adjusted under 35 U.S.C. 154(b) by 46 days.

(21) Appl. No.: 10/207,213

(22) Filed: Jul. 29, 2002

(65) Prior Publication Data

US 2003/0148913 A1 Aug. 7, 2003

Related U.S. Application Data

(63) Continuation-in-part of application No. 09/975,318, filed on Oct. 11, 2001.

(51) Int. Cl.[7] ..... B08B 3/04; C11D 1/72; C11D 3/22; C11D 3/37; C11D 3/50

(52) U.S. Cl. ..... 134/25.2; 134/25.3; 134/39; 134/40; 134/42; 510/235; 510/238; 510/239; 510/240; 510/245; 510/421; 510/470; 510/475; 510/524; 510/535

(58) Field of Search ..... 510/235, 238, 510/239, 240, 245, 421, 470, 475, 524, 535; 134/25.2, 25.3, 39, 40, 42

(56) References Cited

U.S. PATENT DOCUMENTS

| | | | | |
|---|---|---|---|---|
| 3,897,357 A | | 7/1975 | Carmello | 252/106 |
| 3,970,576 A | | 7/1976 | Carmello et al. | 252/106 |
| 4,043,931 A | | 8/1977 | Jeffrey et al. | |
| 4,105,574 A | * | 8/1978 | Culmone et al. | 510/197 |
| 4,299,737 A | | 11/1981 | Meffert et al. | |
| 4,565,647 A | | 1/1986 | Llenado | |
| 4,663,069 A | | 5/1987 | Llenado | |
| 4,678,606 A | | 7/1987 | Akhter et al. | |
| H468 H | | 5/1988 | Malik et al. | |
| 4,818,522 A | | 4/1989 | Ferentchak et al. | |
| 4,852,201 A | | 8/1989 | Wundrock et al. | 15/145 |
| 5,035,814 A | * | 7/1991 | Maaser | 8/137 |
| 5,051,305 A | | 9/1991 | Whitaker, Sr. | |

(List continued on next page.)

FOREIGN PATENT DOCUMENTS

| | | | |
|---|---|---|---|
| DE | 3635535 A1 | | 4/1988 |
| EP | 0 381 529 | | 8/1990 |
| EP | 0 384 034 | | 8/1990 |
| EP | 0590722 A2 | | 4/1994 |
| EP | 0 944 702 B1 | | 5/1998 |
| GB | 1067954 | | 5/1967 |
| JP | 4096999 | | 3/1992 |
| WO | WO 01/81519 | | 11/1992 |
| WO | WO96/35769 | | 11/1996 |
| WO | WO 97/13829 | | 4/1997 |
| WO | WO 98/07809 | | 2/1998 |
| WO | WO 98/10051 | | 3/1998 |
| WO | WO 98/33876 | | 8/1998 |
| WO | WO 00/65005 | * | 11/2000 |
| WO | WO 00/65009 | | 11/2000 |
| WO | WO 00/65011 | | 11/2000 |
| WO | WO 00/65012 | | 11/2000 |
| WO | WO 00/65013 | | 11/2000 |
| WO | WO 01/17372 | | 3/2001 |
| WO | WO03/031550 A1 | | 4/2003 |

*Primary Examiner*—Brian P. Mruk

(57) ABSTRACT

Disclosed herein are hard surface cleaners which provide improved fragrance retention properties to the treated hard surface, and methods for using them. The cleaners include a fragrance, a carrier, and a surfactant selected from ethylene oxide/propylene oxide block copolymers, polyglycosides, ethoxylated alkyl alcohols, and ethylene oxide/propylene oxide copolymers functionalized with a fatty alcohol moiety. The cleaner may also contain water and a base.

10 Claims, 2 Drawing Sheets

U.S. PATENT DOCUMENTS 5,104,585 A 4/1992 Fabry et al.
5,180,749 A * 1/1993 Cusack et al. ..... 514/726
5,188,755 A * 2/1993 Chang ..... 510/193
5,209,874 A 5/1993 Kravetz et al.
5,356,479 A 10/1994 Menke et al.
5,411,585 A * 5/1995 Avery et al. ..... 106/287.1
5,525,256 A 6/1996 Morris et al.
5,540,853 A 7/1996 Trinh et al.
5,631,216 A 5/1997 Morris et al.
5,705,470 A 1/1998 Faris ..... 510/403
5,731,282 A 3/1998 Duquesne
5,733,560 A 3/1998 Davister et al.
5,736,496 A 4/1998 Durbut et al.
5,759,974 A 6/1998 Menke et al.
5,767,056 A 6/1998 Lenoir
5,770,549 A 6/1998 Gross
5,773,406 A 6/1998 Gross
5,780,404 A 7/1998 Bacon et al.
5,854,194 A 12/1998 Davister et al.
5,910,473 A 6/1999 Alfano et al.
5,977,050 A 11/1999 Faris ..... 510/403
5,990,066 A 11/1999 Gordon et al.
6,017,868 A 1/2000 Mondin et al. ..... 510/365
6,025,314 A * 2/2000 Nitsch et al. ..... 510/221
6,051,542 A 4/2000 Pollack et al. ..... 510/426
6,083,901 A 7/2000 Perry et al.
6,096,704 A 8/2000 Bryant, Jr. et al.
6,133,228 A 10/2000 Pika et al.
6,143,353 A 11/2000 Oshlack et al.
6,150,321 A 11/2000 Davister et al.
6,194,362 B1 2/2001 Trinh et al. ..... 510/101
6,194,371 B1 2/2001 Donovan et al.
6,194,375 B1 2/2001 Ness et al.
6,218,355 B1 4/2001 Herrmann
6,221,828 B1 4/2001 Matsuo et al.
6,225,277 B1 5/2001 Gordon ..... 510/475
6,228,833 B1 5/2001 Paatz et al.
6,235,703 B1 5/2001 Appel et al.
6,255,267 B1 7/2001 Nayar et al.
6,316,401 B1 11/2001 Mertens
6,319,887 B1 11/2001 Mertens
2001/0044395 A1 11/2001 Aszman ..... 510/191
2001/0056054 A1 12/2001 Aszman ..... 510/191
2002/0004469 A1 1/2002 Faber ..... 510/180
2002/0045554 A1 4/2002 Hayward et al.
2003/0096725 A1 * 5/2003 Tsibouklis et al. ..... 510/421
2003/0148913 A1 * 8/2003 Klinkhammer et al. ..... 510/421

* cited by examiner

HARD SURFACE CLEANERS WHICH PROVIDE IMPROVED FRAGRANCE RETENTION PROPERTIES TO HARD SURFACES

CROSS-REFERENCE TO RELATED APPLICATION

This application is a continuation-in-part of U.S. application Ser. No. 09/975,318, filed Oct. 11, 2001.

STATEMENT REGARDING FEDERALLY SPONSORED RESEARCH/DEVELOPMENT

Not applicable.

BACKGROUND OF THE INVENTION

The present invention relates to cleaning compositions for hard surfaces. These compositions appear to be especially well suited for use in cleaning toilet bowls, baths, shower surrounds and other plumbing fixtures, bathroom and kitchen hard surfaces, glass windows, and floor surfaces. They render treated or cleaned surfaces hydrophilic and provide such surfaces with excellent anti-fogging properties. Such surfaces treated or cleaned with the compositions of the present invention also resist soiling and colonization by bacteria and fungi, and resist the formation of biofilms. Also, they surprisingly provide improved fragrance release properties.

Products sold under the trademark "PLURONIC" by BASF are a series of one type of closely related block copolymers that may be generically classified as polyoxypropylene-polyoxyethylene condensates terminating in primary hydroxy groups. Such block copolymers are nonionic surfactants and have been used for a wide variety of applications. Block copolymers may also be functionalized (the terminal alcohol converted to an ether) with fatty alcohols, especially primary alcohols having 8–20 carbons. Such block copolymers (also referred to as block copolymers capped with fatty alcohols) are, for example, sold under the trademark "DEHYPON" and are available from Cognis Corporation.

The art has developed a variety of cleaning and/or treating compositions, including some containing block copolymers (or capped derivatives thereof). For example, U.S. Pat. Nos. 5,589,099 and 6,025,314 disclose rinse aid compositions containing such block copolymers where they are employed in dishwashing processes. The disclosure of these patents and all other patents and/or publications described herein are incorporated by reference as if fully set forth herein.

Also, U.S. Pat. No. 5,286,300 teaches that such block copolymers can be used in rinse aid composition for metal surfaces. Further, these block copolymers have utility as nonionic surfactants in halophor-containing cleaning compositions (U.S. Pat. Nos. 5,049,299 and 5,169,552); in contact lens cleaning and storing compositions (U.S. Pat. No. 3,882,036); in compositions for treating plastic surfaces to prevent fogging (U.S. Pat. No. 5,030,280); as a defoamer or low foaming detergent (U.S. Pat. Nos. 5,691,292 and 5,858,279); as a plasticizer in a solid cake cleansing block composition for toilets (U.S. Pat. No. 4,911,858); as a surfactant in organosilane solutions (U.S. Pat. No. 5,411,585); and as a surfactant for reducing bacterial adhesion on surfaces in contact with industrial water systems such as process or cooling water systems (U.S. Pat. No. 6,039,965).

The art has also developed a variety of hard surface cleaning compositions. For example, U.S. Pat. No. 5,990,066 teaches a surface cleaning composition that contains block copolymer surfactants, a carboxylate-containing polymer, and a divalent counterion. The block copolymer is said to provide a gloss benefit to the cleaned surface. Also, U.S. Pat. No. 4,247,408 discloses a hard surface cleaning composition containing a polyoxyalkylene alkyl ether solvent, an acidic substance, and a nonionic surfactant which may be block copolymers.

U.S. Pat. No. 4,539,145 discloses an outside window cleaner containing polyvinyl alcohol and an amine-containing polymer which may also include a nonionic surfactant such as a block copolymer. The block copolymer is said to improve the detergency of the composition. U.S. Pat. No. 5,126,068 also teaches a hard surface cleaning composition containing organic solvents and water, polycarboxylate copolymers, pH adjusters, and certain block copolymer surfactants. It is said that this composition is particularly useful in glass cleaners and that it is substantially streak-free when applied to glossy or transparent surfaces.

U.S. Pat. No. 4,043,931 discloses a solid cleansing block having at least two nonionic surfactants, one of which is relatively insoluble in water and the other of which is relatively water soluble. It is said that such a cleansing block does not erode away as quickly. U.S. Pat. No. 4,299,737 discloses hydroxyalkylether alkoxylates as solubilizers for fat-soluble perfume oils. U.S. Pat. Nos. 5,733,560; 5,854,194; and 6,150,321 disclose chemical linkers which react exothermically with an organic chemical such as a perfume in order to reduce the rate of vaporization of the organic chemical from the surface to which it has been applied.

U.S. Pat. No. 5,736,496 teaches a hard surface cleaner having improved interfacial tension which provides good grease removal properties and leaves the cleaned surface with a shiny appearance. This patent teaches that ethoxylated nonionic surfactants are undesirable because they cause a weakening of the necessary chemical associations.

U.S. Pat. No. 5,759,974 discloses a toilet cleaning block having at least two masses of different compositions to ensure that the active substance is more uniformly released over the useful life of the cleaning block.

U.S. Pat. No. 5,910,473 discloses a thickened bleach composition which may include nonionic surfactants such as alcohol ethoxylates.

U.S. Pat. No. 6,194,375 teaches a perfume that is absorbed within organic polymer particles.

A number of patent publications have discussed the problem of fragrance retention. For example, U.S. Pat. Nos. 4,818,522 and 5,051,305, and European patent applications EP 0 381 529 and EP 0 384 034 teach the microencapsulation of fragrances. U.S. Pat. Nos. 6,096,704; 6,218,355; and 6,133,228, and PCT publication WO 98/07809 disclose pro-fragrance compounds. U.S. Pat. No. 6,083,901 teaches the adsorption of fragrances onto siloxane, and U.S. Pat. Nos. 6,143,353 and 6,228,833 teach the adsorption of fragrances onto polymers. PCT publication WO 01/17372 teaches imbedding a fragrance into a matrix for slow release.

U.S. Pat. Nos. 6,316,401 and 6,319,887 teach a cleaning composition having a nonionic surfactant containing ethoxylated and/or ethoxylated/propoxylated groups, a water insoluble perfume, and a methyl ethoxylated ester cosurfactant. It is said that such compositions have improved interfacial tensions and leave the treated surface shiny.

U.S. Pat. No. 6,255,267 discloses a toilet bowl cleaner having a fluorosurfactant coating agent which inhibits stain and deposit formation.

U.S. Pat. No. 5,731,282 teaches a hard surface cleaner having, inter alia, a nonionic detergent/surfactant (especially nonylphenol ethoxylates), a preservative/disinfectant, and a non-emulsified fragrance or perfume. This patent also discloses that a surface treated with the cleaner has a prolonged, pleasant odor.

While these varied prior art compositions have provided a variety of ways to treat and/or clean hard surfaces, they have been limited in their ability to provide residual benefits to such surfaces. In this regard, it is desirable to render hard surfaces that are being cleaned more resistant to becoming soiled, to provide the surface with antimicrobial characteristics such as resistance to colonization by bacteria, fungi, and biofilms, and to provide the surface with improved and prolonged fragrance release properties. Thus, there is a continuing need to develop hard surface cleaners which not only are effective in cleaning at the time of use, but also provide positive residual benefits to the surface that has been cleaned.

BRIEF SUMMARY OF THE INVENTION

The compositions of the present invention unexpectedly address this need by utilizing block copolymers at low concentrations, such block copolymers having a high average molecular weight.

In one aspect the invention provides a hard surface antimicrobial cleaner. It has one or more surfactants, one of which must be a polyoxyethylene/polyoxypropylene block copolymer (e.g. with a terminal hydroxyl, or where the terminal hydroxyl is functionalized with a fatty alcohol). Preferably, the block copolymer is from 0.2–5% by weight of the composition.

For example, it has been found that a level of from 0.2% to 4% by weight of "PLURONIC F127" provides excellent hydrophilic and anti-fog benefits to treated glass surfaces. Such benefits are also provided to treated polymethyl methacrylate and other plastic surfaces, but at a higher preferred level of from 1.5% to 5% by weight of "PLURONIC F127".

In another aspect of the invention, a hard surface cleaner is provided which renders the cleaned surface with improved fragrance release characteristics. Such cleaners include certain nonionic surfactants which are especially effective in improving the fragrance release properties of hard surfaces treated with the cleaners. Preferred nonionic surfactants include alcohol ethoxylates, alcohol ethoxylate propoxylates (including those functionalized with a fatty alcohol moiety), certain alkyl polyglycosides, and mixtures thereof.

Normally the cleaner will also contain water (preferably more than 50% of the cleaner even more preferably over 90% of the cleaner), and there may be an acid. The cleaners can include a wide variety of other surfactants such as nonionic, anionic, cationic and amphoteric surfactants, and mixtures thereof. Examples of such surfactants are described in McCutcheon's: *Emulsifiers & Detergents*, North American Edition (1995).

Suitable nonionic surfactants include alkyl amine oxides (for example (e.g.), $C_{8-20}$ alkyl dimethyl amine oxides), alkylphenol ethoxylates, linear and branched alcohol ethoxylates, carboxylic acid esters, alkanolmides, alkylpolyglycosides, ethylene oxide/propylene oxide copolymers, and the like. Especially preferred among these are linear and secondary alcohol ethoxylates, octyl- and nonyl-phenol ethoxylates, alkanol amides and alkylpolyglycosides.

Useful zwitterionic/amphoteric surfactants include alkyl aminopropionic acids, alkyl iminopropionic acids, imidiazoline carboxylates, alkylbetaines, sulfobetaines, and sultaines.

Useful cationic surfactants include, for example, primary amine salts, diamine salts, quaternary ammonium salts, and ethoxylated amines.

Useful anionic surfactants (which are preferably used only in conjunction with a nonionic surfactant, if at all) include carboxylic acid salts, alkyl benzene sulfonates, secondary n-alkane sulfonates, alpha-olefin sulfonates, dialkyl diphenylene oxide sulfonates, sulfosuccinate esters, isoethionates, linear alcohol sulfates (alkyl sulfates such as sodium lauryl sulfate), and linear alcohol ethoxy sulfates.

In certain embodiments of the claimed hard surface cleaner, an acid may be included in the composition. Preferred acids are organic acids such as lactic acid, sulfamic acid, citric acid, valeric acid, hexanoic acid, and glycolic acid. Other examples are formic acid, acetic acid, propionic acid, butyric acid, and gluconic acid, and peroxy variants of these acids such as peroxyacetic acid. The acid is preferably less than 10% by weight of the cleaner, even more preferably less than 5% of the cleaner. A preferred pH range for the cleaner when the cleaner is an aqueous solution is 5–11.

There may also be a glycol ether solvent (most preferably ethylene glycol hexyl ether or ethylene glycol butyl ether). This is particularly desirable for kitchen and window cleaners where there is substantial grease that needs to be cleaned. Other possible solvents are terpenes, aliphatic hydrocarbons and alpha-olefins, and organic compounds containing at least one oxygen atom, such as alcohols and ethers. For example, isopropanol is particularly useful as a solvent in the window cleaner compositions of the present invention.

Among these oxygen-containing solvents are aliphatic alcohols of up to 8 carbon atoms, particularly tertiary alcohols of up to 8 carbon atoms; aromatic-substituted alcohols; alkylene glycols of up to 6 carbon atoms; polyalkylene glycols having up to 6 carbon atoms per alkylene group; mono- or dialkyl ethers of alkylene glycols or polyalkylene glycols having up to 6 carbon atoms per glycol group and up to 6 carbon atoms in each alkyl group; mono- or diesters of alkylene glycols or polyalkylene glycols having up to 6 carbon atoms per glycol group and up to 6 carbon atoms in each ester group.

Specific examples of solvents include t-butanol, t-pentyl alcohol; 2,3-dimethyl-2-butanol, benzyl alcohol or 2-phenyl ethanol, ethylene glycol, propylene glycol, dipropylene glycol, propylene glycol mono-n-butyl ether, dipropylene glycol mono-n-butyl ether, propylene glycol mono-n-propyl ether, dipropylene glycol mono-n-propyl ether, diethylene glycol mono-n-butyl ether, diethylene glycol monomethyl ether, dipropylene glycol monomethyl ether, triethylene glycol, propylene glycol monoacetate, and dipropylene glycol monoacetate.

The solvent preferably constitutes no more than 6 weight percent of the composition, more preferably no more than 2 weight percent.

Also, particularly with respect to window cleaners, it may be desirable to include ammonia in the form of ammonium hydroxide to enhance cleaning and raise the pH.

For some applications such as toilet bowl cleaners and bathroom wall cleaners it is particularly desirable that the cleaner also contain a cellulosic thickener. A preferred thickener is hydroxyethyl cellulose. It is preferably present in under 5% by weight of the cleaner. Other suitable cellulosic thickeners include carboxy methyl cellulose, hydroxypropyl cellulose, xantham gums and derivatives, guar gums and derivatives, acrylic thickeners, urethane thickeners, cationic thickeners, such as polyacrylamide types, and clay thickeners, such as bentone or attapulgites.

If desired a disinfectant can be used (preferably benzalkonium chloride). Other possible disinfectants include polyhexamethylene biguanide, phenolic disinfectants, amphoteric disinfectants, anionic disinfectants, and metallic disinfectants (e.g. silver). The cleaning compositions of the present invention may also include colors and/or fragrances. Such colors and fragrances are well known to those skilled in the art of cleaning compositions.

In another form, the invention provides a method of cleaning a hard surface. A standard means of treatment is to apply a cleaner of the above kind against the hard surface (e.g., by spraying), rubbing or scraping the cleaner against the surface, rinsing the surface with water until no more cleaner is visible to the eye, and then lightly wiping the surface until standing water is removed.

By "hard surface" we mean a solid, substantially non-flexible, surface such as a countertop, bathroom tile, plumbing fixture wall, bathroom or kitchen wall, glass window, or linoleum floor. It does not include fabric, carpet, hair, skin, or other softer materials which are highly flexible.

It has been surprisingly learned that the addition of certain block copolymers to a hard surface cleaner causes surfaces that have been cleaned using the cleaner to be left with residual benefits. In particular, the surfaces resist soiling, are easier to clean when stained, and provide resistant to bacteria, fungi, and biofilms. These benefits have been achieved without disrupting the cleaning function of the cleaner.

For purposes of this application, "antimicrobial" shall mean providing more resistance to the growth of at least one bacteria after such a treatment, where the effect is at least in part due to the block copolymer (and not just other disinfectants which may also be present).

The block copolymers useful in the compositions and methods of the present invention may be selected from, for example, block copolymers including first and second blocks of repeating ethylene oxide (EO) units and a block of propylene oxide (PO) units interposed between said first and second blocks of repeating ethylene oxide units. Such block copolymers may have the general structure (I):

$$\mathrm{HO}-(\mathrm{CH_2CH_2O})_x-(\mathrm{CH_2\overset{CH_3}{\overset{|}{C}}HO})_y-(\mathrm{CH_2CH_2O})_z-\mathrm{H} \qquad \text{(I)}$$

wherein x is 0 to 1,000, y is 1 to 1,000, and z is 0 to 1,000, with the proviso that x and z are not both 0. The block copolymers of the above structure (I) preferably have a ratio of ethylene oxide (EO) units to propylene oxide (PO) units of from 1:10 to 10:1; most preferably from 4:6 to 6:4. The preferred average molecular weight of the block copolymer of structure (I) is from 285 to 100,000; more preferred is from 2,000 to 40,000; most preferred is from 8,000 to 20,000.

Additional examples of block copolymers useful in the compositions and methods of the present invention include those wherein the copolymers include first and second blocks of repeating propylene oxide (PO) units and a block of repeating ethylene oxide (EO) units interposed between first and second blocks of repeating propylene units. Such block copolymers may have the general structure (II):

$$\mathrm{HO}-(\mathrm{CH_2\overset{CH_3}{\overset{|}{C}}HO})_x-(\mathrm{CH_2CH_2O})-(\mathrm{CH_2\overset{CH_3}{\overset{|}{C}}HO})_z-\mathrm{H} \qquad \text{(II)}$$

wherein x is 0 to 1,000, y is 1 to 1,000, and z is 0 to 1,000, with the proviso that x and z are not both 0. The block copolymers of the above structure (II) preferably have a ratio of EO units to PO units of from 1:10 to 10:1; most preferably from 4:6 to 6:4. The preferred average molecular weight of the block copolymer of structure (II) is from 280 to 100,000; more preferred is from 2,000 to 40,000; most preferred is from 8,000 to 20,000.

The block copolymers of structures (I) and (II) are available from BASF and are sold under the trademark "PLURONIC". PLURONIC F127 has a structure according to that shown in structure (I) with x being about 99, y being about 67, and z being about 99. PLURONIC F127 has an average molecular weight of about 12,600.

Other useful EO/PO block copolymers are those block copolymers shown in structures (I) and (II) functionalized/capped with fatty alcohols. Such functionalized block copolymers are attractive because they are more biodegradable than the block copolymers shown in structures (I) and (II). By fatty alcohols we mean linear or branched, saturated or unsaturated primary alcohols having 8–20 carbons. Such functionalized block copolymers are disclosed in U.S. Pat. Nos. 5,030,280; 5,411,585; and 6,025,314. Preferably such block copolymers are functionalized with fatty alcohols having 12–14 carbons.

The preferred ratio of EO to PO units of such block copolymers functionalized with fatty alcohols is as set forth above for structures (I) and (II). The preferred average molecular weight for these functionalized block copolymers is as set forth above for structures (I) and (II), except that the average molecular weights are adjusted to account for the average molecular weight of the fatty alcohol used to functionalize the block copolymer. These capped block copolymers are available from Cognis Corporation and are sold under the trademark "DEHYPON". Two preferred block copolymers are DEHYPON LS54 and DEHYPON LS34 which have EO to PO unit ratios of 5:4 and 3:4, respectively. DEHYPON LS54 is especially preferred.

Generally, the compositions of the present invention should contain about 2% of the block copolymer to confer good anti-fogging performance to the treated surface. Particularly surprising, we found that good anti-fogging performance can be conferred to treated surfaces using compositions having as little as 0.25% of the fatty alcohol functionalized block copolymers (e.g. DEHYPON LS54). It was also unexpected that compositions containing as little as 2% of the functionalized block copolymers had the ability to impart resistance to bacterial colonization on the treated surface given the biodegradability of such compounds.

The foregoing and other advantages of the invention will appear from the following description. In that description reference is made to the accompanying drawing which forms the part hereof. These embodiments do not represent the full scope of the invention. Thus, the claims should be looked to in order to judge the full scope of the invention.

DETAILED DESCRIPTION OF THE PREFERRED EMBODIMENTS

Figure 1:
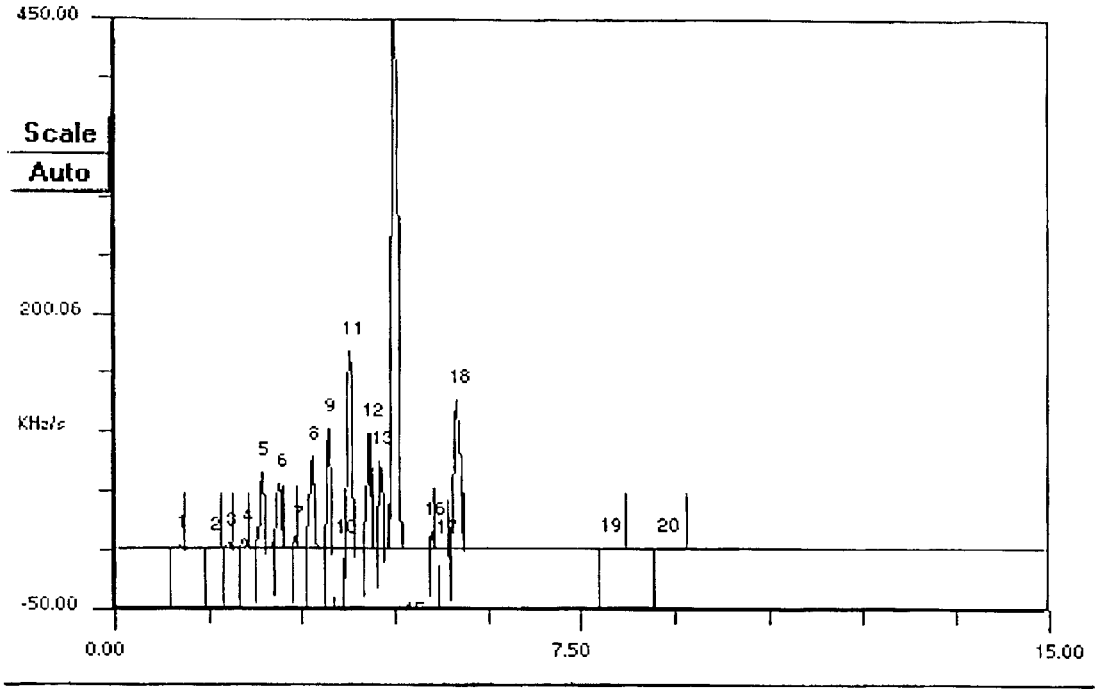
FIG. 1 is a Z-nose spectrum of a control formulation containing fragrance and water.

Preferred examples of the present invention are described below. The first five are two toilet bowl cleaners, a bath and shower cleaner, a kitchen cleaner, and a window cleaner.

EXAMPLE 1

Toilet Bowl Cleaner

| Weight percent | Description | Chemical name |
|---|---|---|
| To 100 | Carrier | Water |
| 2.00 | PLURONIC F127 | EO/PO Block Copolymer |
| 2.50 | Acid | Lactic or glycolic acid |
| — | Thickener | Hydroxyethyl cellulose |
| — | Color | Color |
| — | Fragrance | Fragrance |

EXAMPLE 2

Toilet Bowl Cleaner

| Weight percent | Description | Chemical name |
|---|---|---|
| To 100 | Carrier | Water |
| 1.00 | Nonionic surfactant | Alcohol ethoxylate |
| 2.00 | PLURONIC F127 | EO/PO Block Copolymer |
| 0.50 | Acid | Sulfamic acid |
| 0.50 | Disinfectant | Benzalkonium chloride |
| — | Thickener | Hydroxyethyl cellulose |
| — | Color | Color |
| — | Fragrance | Fragrance |

EXAMPLE 3

Bath and Shower Cleaner

| Weight percent | Description | Chemical name |
|---|---|---|
| To 100 | Carrier | Water |
| 0.50 | Nonionic Surfactant | Polyglucoside |
| 0.50 | Acid | Citric Acid |
| 0.50 | Acid | Lactic Acid |
| 0.50 | PLURONIC F127 | EO/PO Block Copolymer |
| 0.20 | Disinfectant | Benzalkonium chloride |
| — | Thickener | Cellulose derivative |
| — | Color | Color |
| — | Fragrance | Fragrance |

EXAMPLE 4

Kitchen Cleaner

| Weight percent | Description | Chemical name |
|---|---|---|
| To 100 | Carrier | Water |
| 1.00 | Acid | Glycolic Acid |

-continued

| Weight percent | Description | Chemical name |
|---|---|---|
| 0.50 | DEHYPON LS-54 | EO/PO Block Copolymer |
| 0.30 | Nonionic surfactant | Amine Oxide |
| 0.75 | Nonionic surfactant | Polyglucoside |
| 0.57 | Solvent | Ethylene glycol butyl ether |
| 0.43 | Solvent | Ethylene glycol hexyl ether |
| 0.10 | Disinfectant | Benzalkonium chloride |
| — | Fragrance | Fragrance |

EXAMPLE 5

Window Cleaner

| Weight percent | Description | Chemical name |
|---|---|---|
| To 100 | Carrier | Water |
| 3.50 | Solvent | Isopropanol |
| 1.00 | Cleaner/pH modifier | Ammonium hydroxide |
| 0.50 | PLURONIC F127 | EO/PO Block Copolymer |
| 0.33 | Anionic surfactant | Sodium lauryl sulfate (30%) |
| 0.80 | Solvent | Ethylene glycol butyl ether |
| 0.60 | Solvent | Ethylene glycol hexyl ether |
| — | Fragrance | Fragrance |

TESTING

EXAMPLE 6

Antifogging Tests

Comparative tests undertaken to demonstrate the enhanced cleaning and antifogging effect of a formulation containing a block copolymer of the present invention against conventional cleaning formulations.

| Conventional formulation: | |
|---|---|
| Soft water | 94.124% |
| Isopropanol | 3.500% |
| Ethylene glycol monobutyl ether | 0.800% |
| Ethylene glycol n-hexyl ether | 0.600% |
| Ammonia solution (25%) | 0.300% |
| Propylene glycol | 0.250% |
| Monoethanolamine | 0.200% |
| Decy(sulphenoxy)benzene sulphonic acid-disodium salt | 0.150% |
| Fragrance | 0.050% |
| Direct blue 86 | 0.001% |

Block Copolymer Formulation

As above plus 2.0% of PLURONIC F127.

Mirrors treated (with the aforesaid standard treatment) with the block copolymer and conventional formulations were placed over a steaming water bath for periods of up to 15 minutes and the surface continually monitored for areas of fogging. Mirrors treated with the conventional formulation became completely fogged within 2 minutes. However, mirrors treated with the formulation containing PLURONIC F127 remained completely clear for extended periods of time, retaining good reflective qualities.

EXAMPLE 7

Microbiological Tests

Studies were performed to investigate the extent of bacterial colonization on glazed stoneware that had been treated using the above standard treatment with an aqueous toilet-bowl-cleaner formulation incorporating 2% PLURONIC F127 (e.g. Examples 1 and 2). Glazed stoneware tiles washed with the above aqueous formulation were immersed (24 hours) in nutrient broth inoculated with *E. coli*. Microscopic examination of the tiles (after exposure to the bacterial cultures) revealed a marked reduction in the extent of bacterial colonization on the surfaces of the tiles treated with the Examples 1 and 2 formulations as compared to tiles treated with a conventional commercially-available formulation.

Cleaners Providing Improved Fragrance Release Properties to Hard Surfaces

The chemical structure of nearly every known fragrance contains hydrophilic domains. Alcohols and phenols have hydrophilic hydrogen bonds. Esters, aldehydes, organic acids, lactones, and ketones have oxygen atoms possessing lone pairs of electrons. Lone electron pairs create domains of hyrophilicity. Nitrogen containing structures also possess lone pairs of electrons which create domains of hydrophilicity. The chemical structure of fragrances also contain chains and/or rings of hydrocarbons which create hydrophobic domains.

We surprisingly discovered that one can use these properties to formulate hard surface cleaners having an unexpected ability to provide improved fragrance release properties to hard surfaces. Van der Wall forces cause hydrophobic domains to attract each other. Electrostatic forces cause hydrophilic domains to attract each other. Since electrostatic forces are stronger than Van der Waal forces, hydrophilic surfaces should retain fragrance longer.

Household toilet surfaces, however, are hydrophobic. Ceramic and porcelain are non-polar. Furthermore, toilet surface are periodically flushed with water. Water, of course, is hydrophilic.

Preferably, the fragrance used in this aspect of the invention comprises one or more volatile organic compounds which are available from perfumery suppliers such as Firmenich, Inc., Takasago Inc., Noville Inc., Quest Co., International Flavors & Fragrances, and Givaudan-Roure Corp. Most conventional fragrance materials are volatile essential oils. The fragrance may be a synthetically formed material, or a naturally derived oil such as oil of bergamot, bitter orange, lemon, mandarin, caraway, geranium, lavender, orange, origanum, petitgrain, white cedar, patchouli, lavandin, neroli, rose absolute, and the like.

In addition, a wide variety of chemicals are known for perfumery, such as aldehydes, ketones, esters, alcohols, terpenes, and the like. A fragrance can be relatively simple in composition, or can be a complex mixture of natural and synthetic chemical components. Synthetic types of fragrance compositions may be employed, either alone or in combination with natural oils, as described in U.S. Pat. Nos. 4,324,915; 4,411,829; and 4,434,306. Other artificial liquid fragrances include geraniol, geranyl acetate, isoeugenol, linalool, linalyl acetate, phenethyl alcohol, methyl ethyl ketone, methylionone, isobomyl acetate, and the like. One preferred fragrance is Fermenich Lemon manufactured by Fermenich, Inc., Geneva, Switzerland. The fragrance is preferably 1–20% weight by volume (w/v) of the cleaner, more preferably 3–15% w/v, most preferably 6–10% w/v.

Our first challenge was to find cleaner additives that render ceramic surfaces hydrophilic. We estimated hydrophilicity using contact angle and fogging measurements. Next, using infrared analysis we determined which additives were durable or remained on the surface after repeated flushing. Measuring fragrance represented an additional challenge. One cannot gravimetrically measure fragrance retention because it is possible to lose scent down the drain. One must measure the amount of fragrance in the atmosphere directly. We employed Z-Nose for measuring this.

As a result of this investigation we found that cleaners having the following nonionic surfactants showed improved fragrance retention properties.

1. PLURONIC block copolymers as set forth in detail elsewhere in this specification.
2. Fatty alcohol ethoxylate/propoxylates such as $C_{12}H_{25}(OC_2H_4)_5(OC_3H_6)_4OH$ (DEHYPON LS 54) and $C_{12}H_5(OC_2H_4)_3(OC_3H_6)_6OH$ (DEHYPON LS 36).
3. Alkylpolyglycosides such as those available under the tradename GLUCOPON (Henkel, Cincinnati, Ohio). The alkylpolyglycosides have the following formula:

$$RO—(R'O)_x—Z_n$$

where R is a monovalent alkyl radical containing 8 to 20 carbon atoms (the alkyl group may be straight or branched, saturated or unsaturated), 0 is an oxygen atom, R' is a divalent alkyl radical containing 2 to 4 carbon atoms, preferably ethylene or propylene, x is a number having an average value of 0 to 12, Z is a reducing saccharide moiety containing 5 or 6 carbon atoms, preferably a glucose, galactose, glucosyl, or galactosyl residue, and n is a number having an average value of about 1 to 10. For a detailed discussion of various alkyl glycosides see U.S. Statutory Invention Registration H468 and U.S. Pat. No. 4,565,647. Some preferred GLUCOPONS are as follows (where Z is a glucose moiety and x=0)

| Product | n | R(# carbon atoms) |
|---|---|---|
| 425N | 2.5 | 8–14 |
| 425LF | 2.5 | 8–14 |
| | | (10 w/w % star-shaped alcohol added) |
| 220UP | 2.5 | 8–10 |
| 225DK | 2.7 | 8–10 |
| 600UP | 2.4 | 12–14 |
| 215CSUP | 2.5 | 8–10 |

4. Ethoxylated nonylphenols such as TERGITOL NP9 (Union Carbide, South Charleston, W.Va.). TERGITOL NP9 contains an ethoxylated nonylphenol having the formula $C_9H_{19}—C_6H_5—O—(C_2H_4O)_9—H$.
5. Alcohol ethoxylates such as those available under the trade name LUTENSOL (BASF, Ludwigshafen, Germany). These surfactants have the general formula $C_{13}H_{25}/C_{15}H_{27}—(OC_2H_4)_n—OH$ (the alkyl group is a mixture of $C_{13}/C_{15}$). Especially preferred are LUTENSOL AO3(n=3), AO8(n=8), and AO10 (n=10).

The nonionic surfactant of this aspect of the invention is preferably 0.1–30% w/v of the cleaner, more preferably 0.5–20% w/v, most preferably 1–7% w/v. The total surfactant in the cleaner (nonionic surfactants plus other surfactants) is preferably 5–30% w/v, more preferably 10–20% w/v, most preferably 12–15% w/v.

Additives Investigated

1. PLURONICS: F127, F108, F77, F68

The general structure of these PLURONICS is as set forth in structure (I) above.

The following PLURONICS (Table 1) were chosen to cover a range of EO and PO chain lengths and different ratios of chain lengths (x:y:z), as well as differences in hydrophilic/lipophilic balance.

TABLE

| Candidate Pluronics | | | | | | | |
|---|---|---|---|---|---|---|---|
| | EO-PO-EO | | | Mol. | | | Gel |
| | x | y | z | wt | HLB* | Detergency | Form[n] |
| F68 | 75 | 30 | 75 | 8350 | 29 | higher | lower |
| F77 | 51 | 35 | 51 | 6600 | 25 | higher | lower |
| F108 | 128 | 54 | 128 | 14000 | 28 | lower | higher |
| F127 | 98 | 67 | 98 | 11500 | 22 | lower | higher |

*Hydrophilic/lipophilic balance-higher HLB indicates more hydrophilic

2. Glycols: Polyethylene, Polypropylene
3. Alcohol Ethoxylate/Propoxylates: DEHYPON LS54, LS36 (both are lauryl alcohol ethoxylates); LS54 contains 5 ethylene oxide units and 4 propylene oxide units; LS36 contains 3 ethylene oxide units and 6 propylene oxide units)
4. Alkylpolyglycosides: GLUCOPON range (USA)—425N, 425LF, 220UP, 225DK, 600UP; (Euro)—425N/HN, 215CSUP, 225, 600

EXAMPLE 8

Contact Angle Measurements

The surfaces of glass, ceramic and porcelain are chemically very similar. Dilute aqueous solutions of PLURONICS (0.5% w/v, 2% w/v, 4% w/v, 10% w/v, and 20% w/v); alcohol ethoxylates (2% w/v and 4% w/v); alkyl polyglycosides (2% w/v and 4% w/v) were sprayed onto clean, dry, glass microscope slides (50×20×1 mm, chromic acid cleaned). The slides were wiped dry with lens cleaning tissues then placed into petri dishes to avoid contamination. Triplicate slides were prepared for each test solution. Contact angles were measured on a goniometer (the amount of surfactant did not influence the measurement). It should be noted that the goniometer software was unable to make an accurate measurement below 10 degrees. The value <10° indicates that the treated surface was very hydrophilic.

Since contact angles of individuals within each group were the same, results were grouped as follows:

| | |
|---|---|
| PLURONICS | <10° |
| Glycols | <10° |
| Alcohol Ethoxylates | <10° |
| Alkylpolyglycosides | <10° |

EXAMPLE 9

Fogging Measurements

The phenomenon of fogging of a glass or mirror surface when introduced into a steam-laden atmosphere is due to numerous small droplets of condensing water. However, the application of a hydrophilic product to the surface of a mirror or a glass ensures a clear surface without fogging for a significant period of time. In the presence of a hydrophilic surface layer, condensing water cannot form droplets but must spread out into a uniform film over the surface. As a result, the reflective surface of the mirror is not obscured and a clear image is obtained. Thus, the anti-fogging characteristics of such a treated surface indicates the presence of a hydrophilic layer.

A mirror cleaned with the aqueous solution was placed over a steaming water bath at 80° C. The surface was then continually monitored. The time at which fogging of the surface, or distortions of the image first occurred, was measured.

TABLE 1

| Fogging Resistance of Pluronics on Glass | | | | |
|---|---|---|---|---|
| % w/v | F127 | F77 | F108 | F68 |
| 0.1% | No fogging but distortions (50%) after 2 min | No fogging but distortions (40%) after 2 min | Fogging (5%) and distortions (20%) after 2 min | Distortions (15%) after 2 min then (40%) after 5 min |
| 0.5% | No fogging but distortions (40%) after 5 min | Distortions (40%) after 2 min | | No fogging but distortions (15%) after 5 min |
| 1.0% | No fogging clear for 15 min. | clear for 5 min then slight fogging (1%) for 10 min. | Clear for 5 min then slight distortions (2%) for 10 min | Clear for 5 min then distortions (5%) for 10 min |
| 2.0% | No fogging clear for 10 min | No fogging clear for 10 min | No fogging clear for 10 min | No fogging clear for 10 min |
| 4.0% | No fogging clear for 15 min | No fogging clear for 15 min | | |

TABLE 2

| Anti-fogging testing for Dehypon | | |
|---|---|---|
| % w/v | Dehypon LS54 | Dehypon LS36 |
| 1.0% | No fogging Clear for 10 min | No fogging Clear for 10 min |
| 0.5% | No fogging Clear for 10 min | No fogging Clear for 10 min |
| 0.25% | No fogging but very slight distortions 5% for 10 min | No fogging but very slight distortions 5% for 10 min |
| 0.1% | Fogging after 2 min | Fogging after 2 min |

TABLE 3

| Anti-fogging tests for Glucopons (USA) | | | | | |
|---|---|---|---|---|---|
| % w/v | 220 | 225DK | 425LF | 425N | 600 |
| 4% | No fogging but distortions | No fogging Clear for 2 min 10% | No fogging Clear for 10 min | No fogging Clear for 2 min 20% | No fogging but distortions |

TABLE 3-continued

Anti-fogging tests for Glucopons (USA)

| % w/v | 220 | 225DK | 425LF | 425N | 600 |
|---|---|---|---|---|---|
| | 25% after 2 min 15% after 10 min | distortions after 10 min | | distortions after 10 min | 10% after 2 min 20% after 10 min |
| 2% | No fogging but distortions 50% after 2 min 30% after 10 min | No fogging but distortions 10% after 2 min 20% after 10 min | No fogging but distortions 15% after 2 min 25% after 10 min | No fogging but distortions 40% after 2 min 50% after 10 min | 60% distortions within 2 min |
| 1% | 100% fogging | No fogging but distortions 15% after 2 min 40% after 10 min | No fogging but distortions 40% after 2 min 30% after 10 min | 80% fogging | 90% fogging |

TABLE 4

Anti-fogging tests for Glucopons (Euro)

| % w/v | 215 CSUP | 225 DK | 425 N/HN | 600 CSUP |
|---|---|---|---|---|
| 4% | No fogging but distortions 30% after 2 min 40% after 10 min | No fogging but distortions 60% within 2 min | Clear for 10 min | Clear for 10 min |
| 2% | 70% fogging | 50% fogging | No fogging but distortions 30% after 2 min 50% after 10 min | Clear for 10 min |
| 1% | 80% fogging | 50% fogging | No fogging but distortions 50% after 2 min 70% after 10 min | No fogging but distortions 80% after 2 min |

EXAMPLE 10

Durability Studies of Surface Films on Immersion in Water

The following procedure was used for measuring durability of submerged films.

The surface of a zinc selenide crystal was flushed with an aqueous solution of the material under test, drained, and allowed to air dry. The aqueous surfactant solutions tested are the same as set forth in Example 8. The treated crystal was placed into the ATRIR (attenuated total reflectance infrared spectrometer) and the IR spectrum recorded. Water was then added to the crystal trough. A spectrum was recorded immediately and at timed intervals thereafter for 12 hours. Peak area of a major absorbance (1070 $cm^{-1}$) was recorded for each spectrum. This data was used to calculate the percentage loss of material from the surface over time, following the addition of water.

The three most hydrophilic materials were chosen for this study: PLURONIC F127, DEHYPON LS 54 and GLUCOPON 425. Infrared spectra of these materials in aqueous solution exhibited a peak in the region of 1100 $cm^{-1}$ which was not present in the water spectra. The intensity of this peak was used to monitor the loss of material from the surface of the crystal.

The studies were carried out over periods up to 12 hours. In all cases, the majority of the material was lost in the first 30 minutes of immersion. A comparison of the three hydrophilic materials under investigation shows that the PLURONIC F127 and DEHYPON LS 54 both performed similarly. GLUCOPON 425 was the least durable and almost disappeared completely after 5 hours.

EXAMPLE 11

Z-Nose Analysis

Z-nose is an instrument that measures the concentration of extremely small amounts of chemicals in the atmosphere. Each formulation was placed in an in-tank continuous action toilet bowl cleaning system. The formulations studied are shown in Table 5a. In such a system, the cleaner is metered into the tank water during each flush. The Z-nose measurement in Table 5b were taken after 6 flushes (which is the average flushes per day of a toilet in consumer use). The Z-nose probe was maintained in a fixed position through a hole in a closed toilet bowl lid and the spectra of each sample was recorded.

The Z-nose instrument is available form Electronic Sensor Technology, L. P., Newbury Park, Calif. For a discussion of the Z-nose technology see E. J. Staples, "The zNose, A New Electronic Nose Using Acoustic Technology,: *Acoustical Society of America*, December 2000 (Paper No. 2aEA4) and E. J. Staples, "Electronic Nose Simulation of Olfactory Response Containing 500 Orthogonal Sensors in 10 seconds," Proceedings of the 1999 IEEE Ultrasonics Frequency Control and Ferroelectrics Symposium, Lake Tahoe, Calif., Oct. 18–21, 1999.

The peak at 4.5 minutes corresponds to the highest peak in the fragrance spectrum. Z-nose generates peak areas. Fragrances contain mixtures of essential oils. Integrating the area under the largest peak in the spectra (in this case, the peak at 4.5 minutes) provided a method for directly comparing the amount of fragrance released to the atmosphere among formulations of differing composition.

Figure 2:
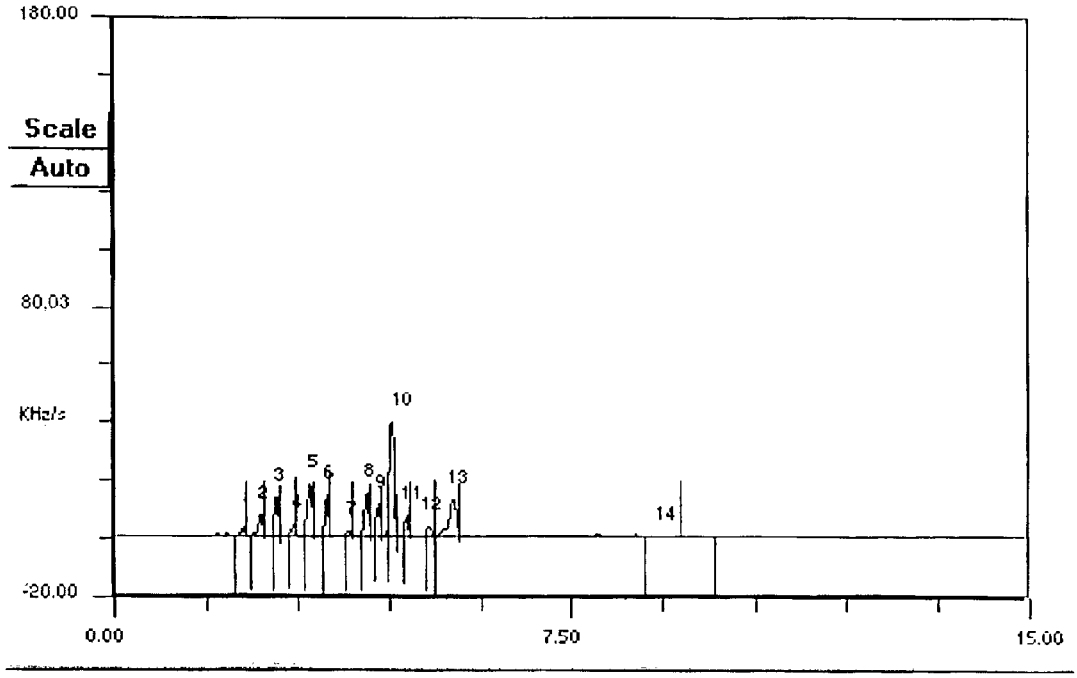
FIG. 2 is a Z-nose spectrum of a hard surface cleaner according to the present invention which provides improved fragrance retention properties to hard surfaces.

FIG. 1 shows a z-nose spectrum for a control formulation containing a fragrance and water. FIG. 2 shows a Z-nose spectrum for a hard surface cleaner according to the present invention which provides improved fragrance retention properties to hard surfaces.

TABLE 5a

| Ingredient | Formulations studied A | B | C | D | E | F | G |
|---|---|---|---|---|---|---|---|
| DI Water | 78.843 | | | | | | |
| Soft Water | | 74.518 | 73.498 | 73.498 | 73.498 | 73.498 | 73.498 |
| EMAL 270 | 5.860 | 8.120 | 8.120 | 8.120 | 8.120 | 8.120 | 8.120 |
| Firmenich Lemon | 5.650 | 6.490 | 6.490 | 6.490 | 6.490 | 6.490 | 6.490 |
| Dipropylene | 5.270 | 6.060 | 6.060 | 6.060 | 6.060 | 6.060 | 6.060 |
| Lutensol A08 | 3.770 | 4.120 | | | | | |
| Dequest 2010 | 0.380 | 0.433 | 0.433 | 0.433 | 0.433 | 0.433 | 0.433 |
| Caustic Soda 50% | 0.226 | 0.257 | 0.257 | 0.257 | 0.257 | 0.257 | 0.257 |
| Myacide BT | 0.002 | 0.002 | 0.002 | 0.002 | 0.002 | 0.002 | 0.002 |
| Dehypon LS 54 | | | 5.140 | | | | |
| Dehypon LS 36 | | | | 5.140 | | | |
| Propylene glycol | | | | | 5.140 | | |
| Butanol | | | | | | 5.140 | |
| Tergitol NP9 | | | | | | | 5.140 |
| Total | 100.000 | 100.000 | 100.000 | 100.000 | 100.000 | 100.000 | 100.000 |

Z-Nose Results

TABLE 5b

| Formula | Additive | Total Area |
|---|---|---|
| A | A08/Hard Water | 169254 |
| B | AO8/Soft Water | 147751 |
| C | Dehypon LS 54 | 312788 |
| D | Dehypon LS 36 | 191324 |
| E | Propylene Glycol | 92858 |
| F | Butyl alcohol | 95461 |
| G | Tergitol NP 9 | 54255 |

Additional formulations having 5% w/v of a nonionic surfactant were studied as set forth in Table 6a. The nonionic surfactants studied were Lutensol A030, Lutensol A010, Lutensol A08, Lutensol A03, Glucopon 425, Dehypon LS36, Dehypon LS54, Pluronic F127, Propylene glycol, and Tergitol NP9. Z-nose measurements for each formulation were then taken after successive flushes (in most cases after flushes 2 through 10), as shown in Table 6b. The measurement methodology was as set forth above in connection with Table 5b.

TABLE 6a

| Ingredient | |
|---|---|
| Soft Water | 62.746 |
| EMAL270 | 20.000 |
| Fragrance | 6.000 |
| DP Glycol | 5.600 |
| Nonionic surfactant | 5.000 |
| Dequest | 0.400 |
| Caustic 50% | 0.238 |
| Myacide BT | 0.016 |
| Total | 100.000 |

TABLE 6b

| Flush | Area AO30 | Area AO10 | Area AO3 | Area AO8 | Area Glucopon | Area LS36 | Area LS54 | Area F127 | Area Propylene Glycol | Area Tergitol NP9 |
|---|---|---|---|---|---|---|---|---|---|---|
| 0 | | | | | | | | | | |
| 1 | | | | | | | | | | |
| 2 | 110.62 | 87.912 | 138.23 | 67.863 | 191.94 | 193.77 | 142.61 | 84.714 | 80.987 | 12.561 |
| 3 | 177.59 | 269.18 | 638.02 | 257.55 | 529.09 | 531.15 | 483.98 | 416.84 | 113.78 | 154.48 |
| 4 | 342.03 | 800.55 | 1073 | 691.32 | 1018.28 | 1232.6 | 1021.9 | 756.28 | 297.98 | 575.48 |
| 5 | 502.49 | 1350.8 | 1289.8 | 1418.6 | 1511.63 | 1936.1 | 1503.9 | 1696.4 | 517.57 | 1100.5 |
| 6 | 811.84 | 1249 | 2082.4 | 1585 | 1906.33 | 2101 | 2110.9 | 2355.8 | 815.48 | 1517.5 |
| 7 | 1197.7 | 1333.6 | 2552.8 | 1884.8 | 2423.86 | 2329.4 | 2827.6 | 2322.1 | 961.63 | 2057.7 |
| 8 | 1273.8 | 1804.4 | 2445.8 | 2127.6 | 2669.85 | 3241.4 | 2860.3 | 2788 | 1405 | 2698.8 |
| 9 | 1543.3 | 1883.2 | 2859.8 | 2370.2 | 2785.88 | 2944.1 | 3134.4 | 3339.2 | 1473.8 | 3041.9 |
| 10 | 1642 | 1674.4 | 3307.5 | 2889.8 | | | | | 1270 | 3378.3 |

Normally the cleaner providing improved fragrance retention properties to hard surfaces will also contain water (preferably more than 50% w/v of the cleaner, even more preferably over 70% w/v of the cleaner).

The cleaners of this aspect of the invention can also include chelating agents. One preferred chelating agent is DEQUEST 2010 (Solutia, St. Louis, Mo.). However, any chelating agent that does not cause the solution pH to change dramatically (preferably pH 2–10, most preferably 5–7) would be suitable. Alternative chelating agents include EDTA, NTA, citric acid, acrylics, maleic anhydride acrylic copolymers, gluconates, sorbitols, trizaoles, phosphonates, and salts of the foregoing.

Typically, sodium hydroxide is used to adjust the cleaning formulation to the desired pH. However, any base would be suitable, including amines and carbonates.

The cleaners of this aspect of the invention can also include biocides. One preferred biocide is 2-bromo-2-nitropropane-1,3-diol such as Myacide BT (Angus, Buffalo Grove, Ill.). Since biocides are added to the cleaners to prevent bacteria from contaminating the packaged cleaner where no air is present, any anaerobic biocide will work. Examples include triazines, dithiocarbonates, isothiazolines, oxazolidines, pyrithione, glutaraldehyde, and formaldehyde.

The cleaners of this aspect of the invention can also include other surfactants. For example, the cleaner can include sodium diethoxylauryl sulfate such as EMAL 270 (Kao Corporation, Tokyo, Japan) and dipropylene glycol. It has also been surprisingly discovered that hard surface cleaners containing mixtures of the nonionic surfactants of the present invention (e.g. Lutensol A08 and Glucopon 425) have unexpectedly synergistic fragrance release properties.

Method of Forming Preferred Embodiments

The above cleaners can be formulated by adding the components to water and then mixing at room temperature.

Thus, the present invention provides effective cleaners that not only clean hard surfaces, but also leave desirable residual properties on the surfaces after the cleaning.

Thus, while specific embodiments have been described, various modifications within the breadth and scope of the invention may be made. The following claims should be looked to in order to understand the full scope of the invention.

INDUSTRIAL APPLICABILITY

The present invention provides improved hard surface cleaners.

We claim:

1. A hard surface cleaner capable of providing increased fragrance retention properties to hard surfaces that have been treated with the cleaner, the cleaner comprising:

a surfactant mixture comprising an alkyl polyglycoside having the formula RO—$Z_n$, wherein R is an alkyl group having 8 to 14 carbon atoms, Z is a glucose moiety, and n is a number having an average value of about 2.5 and an ethoxylated mixed $C_{13}$ and $C_{15}$ alcohol with from 3 to 10 ethylene oxide units, the surfactant mixture being from 0.5% w/v to 20% w/v of the cleaner;

a fragrance; and a carrier.

2. The hard surface cleaner of claim 1, wherein the carrier is water.

3. The hard surface cleaner of claim 1, further comprising a base.

4. The hard surface cleaner of claim 3, wherein the base is sodium hydroxide.

5. The hard surface cleaner of claim 1, further comprising a glycol solvent.

6. The hard surface cleaner of claim 1, further comprising an anionic surfactant.

7. The hard surface cleaner of claim 1, further comprising a biocide.

8. The hard surface cleaner of claim 1, further comprising a chelating agent.

9. The hard surface cleaner of claim 2, wherein the water is at least 50% by weight of the cleaner.

10. A method of cleaning a hard surface, comprising:

applying the hard surface cleaner of claim 1 against a hard surface; and then rinsing the surface with water and/or wiping the surface;

whereby the hard surface has been provided with increased fragrance retention properties.

* * * * *